US010247524B1

(12) United States Patent
Caruso

(10) Patent No.: US 10,247,524 B1
(45) Date of Patent: Apr. 2, 2019

(54) COLLAR CLIP FOR BEAR SPRAY AND CROWD CONTROL AEROSOL DEVICES

(71) Applicant: Avanti USA Ltd., Tonawanda, NY (US)

(72) Inventor: Albert P. Caruso, Tonawanda, NY (US)

(73) Assignee: Avanti USA Ltd., Tonawanda, NY (US)

( * ) Notice: Subject to any disclaimer, the term of this patent is extended or adjusted under 35 U.S.C. 154(b) by 0 days.

(21) Appl. No.: 15/837,230

(22) Filed: Dec. 11, 2017

(51) Int. Cl.

| | |
|---|---|
| ***F41H 9/10*** | (2006.01) |
| ***B65D 83/22*** | (2006.01) |
| *B65D 83/14* | (2006.01) |
| *B65D 83/20* | (2006.01) |
| *A44C 5/00* | (2006.01) |

(52) U.S. Cl.
CPC ..... *F41H 9/10* (2013.01); *B65D 83/22* (2013.01); *A44C 5/0007* (2013.01); *B65D 83/202* (2013.01); *B65D 83/752* (2013.01)

(58) Field of Classification Search
CPC ..... F41H 9/10; B65D 83/202; B65D 83/22; B65D 83/752; A44C 5/0007
USPC ..... 222/175, 470–472
See application file for complete search history.

(56) References Cited

U.S. PATENT DOCUMENTS

| | | | | |
|---|---|---|---|---|
| 3,178,070 | A | 4/1965 | Leland | |
| 3,229,851 | A | 1/1966 | Horwitt et al. | |
| 3,450,313 | A | 6/1969 | Jonas | |
| 3,809,319 | A | 5/1974 | Kimura | |
| 4,141,445 | A | 2/1979 | Korich | |
| 4,186,855 | A * | 2/1980 | Edman | B05B 11/3057 222/321.8 |
| 4,449,647 | A * | 5/1984 | Reed | B65D 83/202 220/759 |
| 4,826,054 | A | 5/1989 | Frutin | |
| 5,420,766 | A * | 5/1995 | Hollis | F21V 33/0064 222/113 |
| 5,427,281 | A | 6/1995 | Query et al. | |
| 5,531,359 | A * | 7/1996 | Winner | B65D 83/384 222/153.11 |
| 5,806,669 | A | 9/1998 | Kim | |
| 6,474,510 | B2 | 11/2002 | Frutin | |
| 6,644,513 | B1 * | 11/2003 | Nesbitt | A44C 25/002 222/175 |
| 6,652,704 | B2 | 11/2003 | Green | |
| 7,104,468 | B2 * | 9/2006 | Stengel | B05B 11/0005 239/151 |
| 7,807,102 | B1 | 10/2010 | Rezaizadeh et al. | |
| 7,988,020 | B2 | 8/2011 | Shohum et al. | |
| 8,499,974 | B2 | 8/2013 | Bennett | |
| 8,720,756 | B2 | 5/2014 | Parsons | |

(Continued)

FOREIGN PATENT DOCUMENTS

EP 3118562 A1 * 1/2017 ..... G08B 15/004

*Primary Examiner* — Donnell A Long
(74) *Attorney, Agent, or Firm* — Simpson & Simpson, PLLC

(57) ABSTRACT

A collar clip for securing an aerosol canister, including a collar arranged to engage the aerosol canister, including a top, a bottom, a first outward facing surface, a first inward facing surface, and a notch arranged proximate the top and extending radially outward from the first outward facing surface, and a clip, including a first end connected to the collar, a second end, a second inward facing surface, and a second outward facing surface.

20 Claims, 6 Drawing Sheets

(56) References Cited

U.S. PATENT DOCUMENTS

| | | | | |
|---|---|---|---|---|
| 9,505,015 | B2 | 11/2016 | Conway et al. | |
| D778,159 | S | 2/2017 | Conway et al. | |
| 9,750,333 | B1 | 9/2017 | Wesenhagen | |
| D798,713 | S | 10/2017 | Bramwell et al. | |
| D798,714 | S | 10/2017 | Bramwell et al. | |
| D799,965 | S | 10/2017 | Boulding et al. | |
| 2002/0066758 | A1 | 6/2002 | Fadal, II et al. | |
| 2004/0031829 | A1 | 2/2004 | Guimond et al. | |
| 2005/0258204 | A1 | 11/2005 | Evans et al. | |
| 2008/0000939 | A1 | 1/2008 | Walsh | |
| 2008/0083799 | A1 | 4/2008 | Kramer et al. | |
| 2009/0294615 | A1* | 12/2009 | Huang | B65D 83/202 248/229.22 |
| 2011/0210146 | A1* | 9/2011 | Dapper | F41H 9/10 222/113 |
| 2012/0298704 | A1 | 11/2012 | Sanz | |
| 2013/0048678 | A1 | 2/2013 | Salazar | |
| 2014/0252036 | A1 | 9/2014 | Ballard | |
| 2014/0263501 | A1 | 9/2014 | Bajuyo | |
| 2014/0284363 | A1 | 9/2014 | Fisher et al. | |
| 2014/0291359 | A1 | 10/2014 | Rose | |
| 2014/0291364 | A1 | 10/2014 | Sorofman et al. | |
| 2015/0001265 | A1 | 1/2015 | Hart | |
| 2015/0069100 | A1 | 3/2015 | Blood et al. | |
| 2015/0090736 | A1 | 4/2015 | Erickson et al. | |
| 2015/0097011 | A1 | 4/2015 | Clifton, Jr. | |
| 2015/0203279 | A1 | 7/2015 | Falcon et al. | |
| 2016/0167074 | A1 | 6/2016 | Berkerman | |

* cited by examiner

COLLAR CLIP FOR BEAR SPRAY AND CROWD CONTROL AEROSOL DEVICES

TECHNICAL FIELD

The invention relates generally to a collar clip for an aerosol canister, and, more specifically, to a collar clip that can be assembled to an aerosol canister to secure the aerosol canister to a user.

BACKGROUND

Clips for aerosol or spray canisters typically include an actuator to engage the stem of the canister in order to dispel the canister's contents. There are a variety of aerosol dispensers that are used in many applications which include dispensing perfume, air fresheners, personal hygiene products, covering an article with a coat of paint, and dispensing cleaning products, amongst others. One specific application for an aerosol dispenser is as a personal defense device that, for example, directs a chemical repellant spray towards a potential human or animal threat. For example, Kodiak bear spray or ballistic crowd control spray.

Typical aerosol canisters come in a cylindrical shape with no way of securing it to the user's body. With respect to personal defense devices, easy access to dispensing the contents of the canister is crucial to ensure the safety of the user when a threat presents itself. However, the reason personal defense devices are effective is because their chemical contents are indiscriminately extremely painful to anyone or anything that comes into contact with it. Thus, it is important that the user has quick access to the canister without having to carry it in hand. It is also important for the user to know exactly which direction the nozzle is pointed in such that the contents can be dispensed in an accurate direction.

Therefore, there is a long-felt need for an improved clip for an aerosol or spray canister that can be easily attachable to a user's clothing such that it is easily accessible, and also interlocks with the nozzle such that the user knows which direction the nozzle is pointed.

SUMMARY

According to aspects illustrated herein, there is provided a collar clip for securing an aerosol canister, comprising a collar arranged to engage the aerosol canister, including a top, a bottom, a first outward facing surface, a first inward facing surface, and a notch arranged proximate the top and extending radially outward from the first outward facing surface, and a clip, including a first end connected to the collar, a second end, a second inward facing surface, and a second outward facing surface.

According to aspects illustrated herein, there is provided a collar clip for securing an aerosol canister, comprising a collar arranged to engage the aerosol canister, including a first frusto-conical section defining a top, the first frusto-conical section having a first outward facing surface, and a first inward facing surface, a second cylindrical section defining a bottom, and a notch arranged proximate the top and extending radially outward from the first outward facing surface, and a clip, including a first end connected to the second cylindrical section, a second end, a second inward facing surface, and a second outward facing surface.

According to aspects illustrated herein, there is provided a collar clip and nozzle assembly for securing an aerosol canister, comprising a nozzle including a front section, a collar arranged to engage the aerosol canister, including a top, a bottom, a first outward facing surface, a first inward facing surface, a notch extending radially outward from the first outward facing surface, and engaged with the front section to non-rotatably connect the collar and the nozzle; and, a plurality of alignment fins extending radially inward from first inward facing surface, and a clip, including a first end connected to the second cylindrical section, a second end, a second inward facing surface, and a second outward facing surface.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1A:
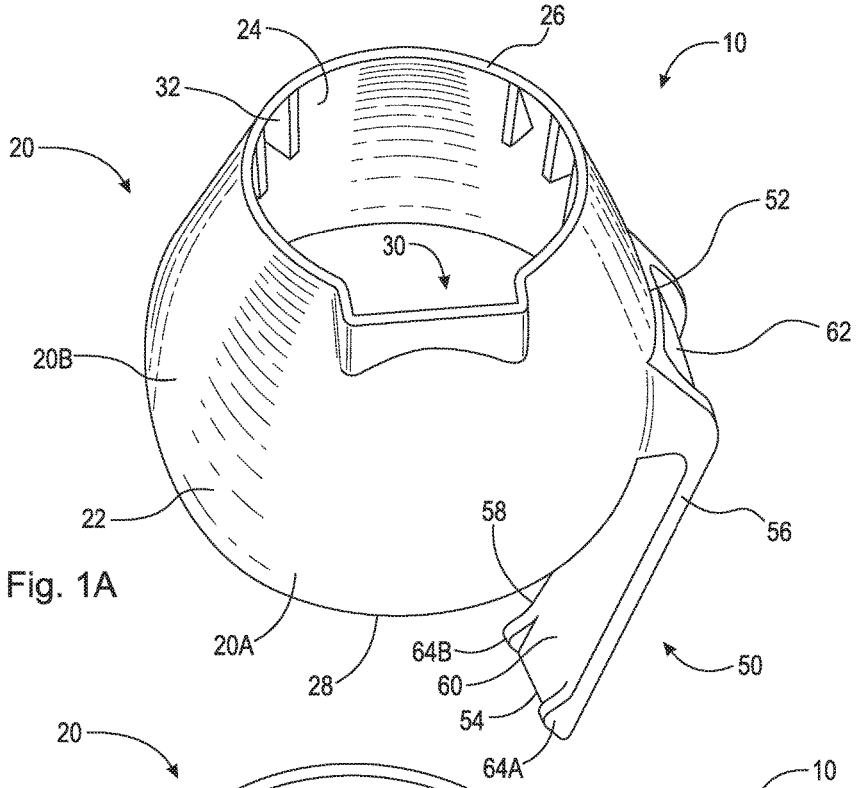
FIG. 1A is a top perspective view of a collar clip.
Figure 1B:
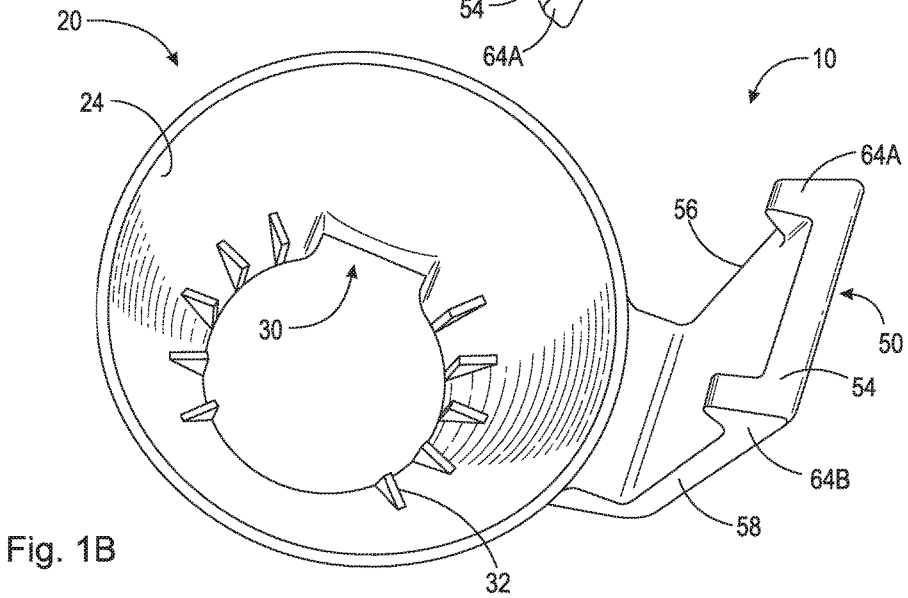
FIG. 1B is a bottom perspective view of the collar clip shown in FIG. 1.
Figures 2A, 2B:
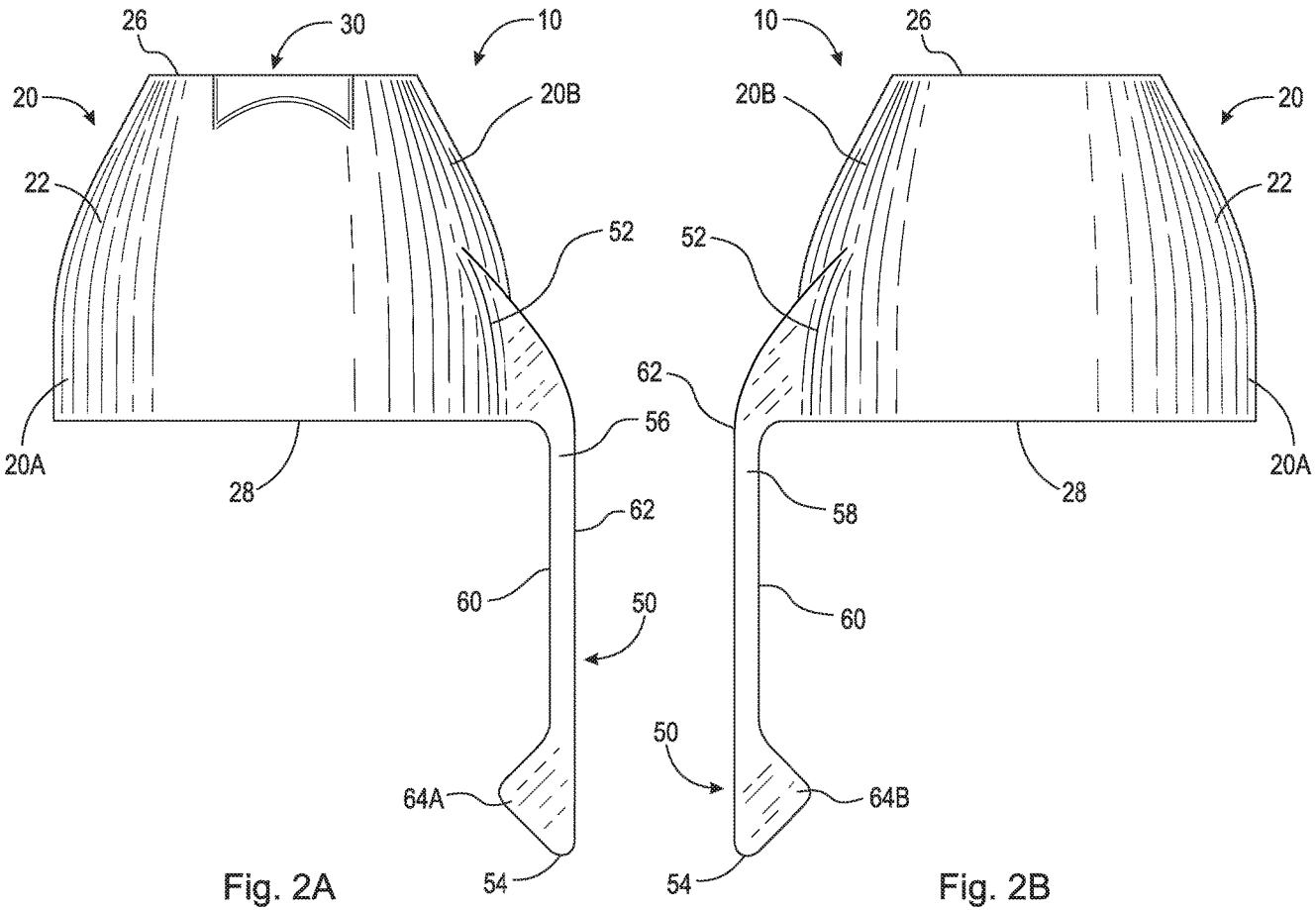
FIG. 2A is a front elevational view of the collar clip in FIG. 1.
FIG. 2B is a rear elevational view of the collar clip in FIG. 1.
Figure 2D:
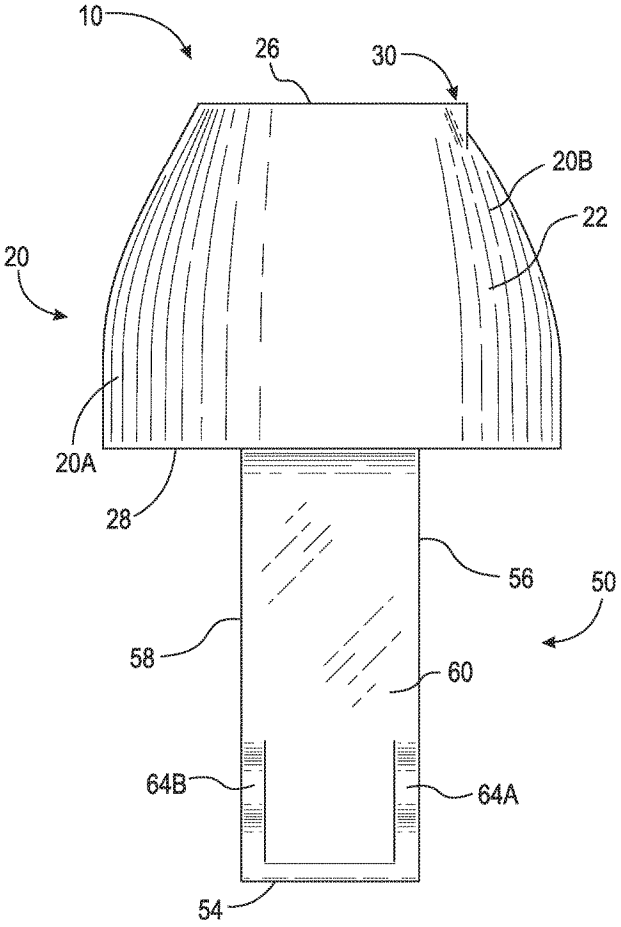
FIG. 2D is a left side elevational view of the collar clip in FIG. 1.
Figure 2C:
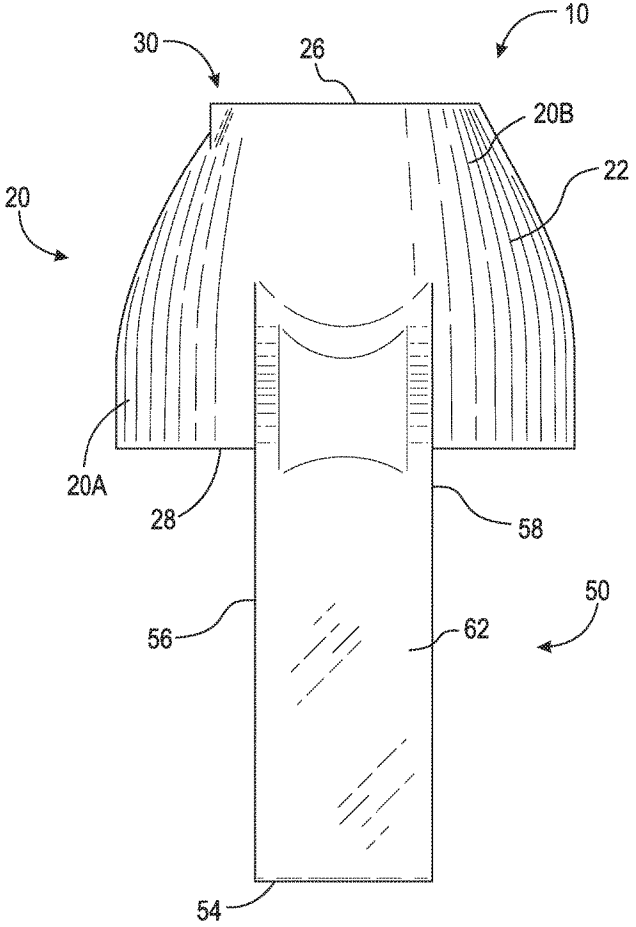
FIG. 2C is a right side elevational view of the collar clip in FIG. 1.
Figure 2F:
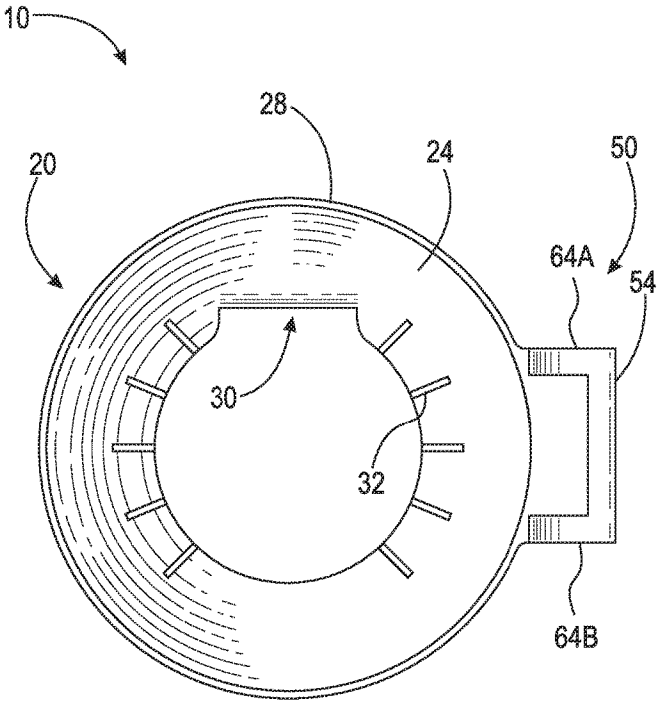
FIG. 2F is a bottom elevational view of the collar clip in FIG. 1.
Figure 2E:
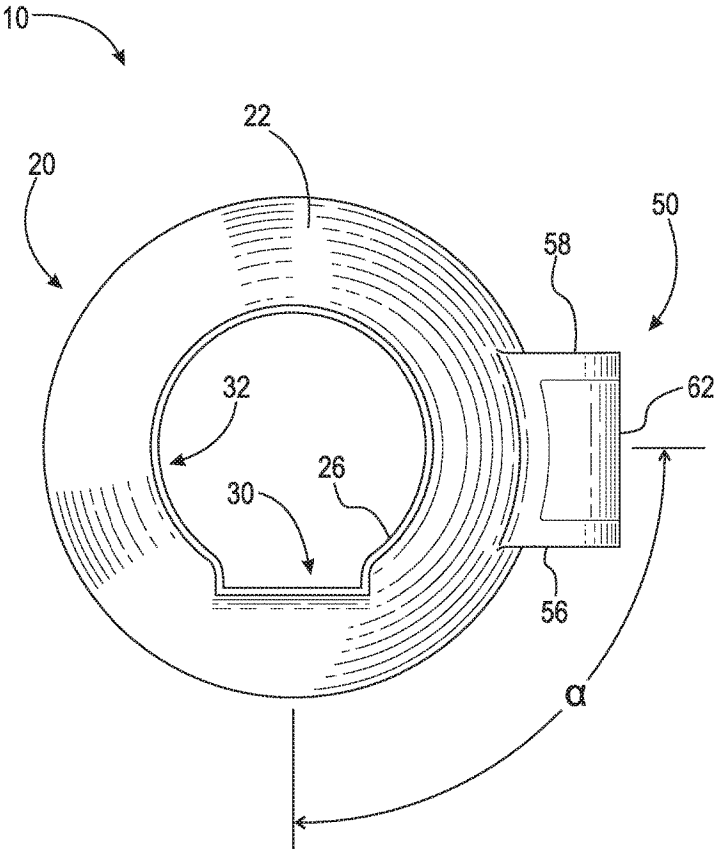
FIG. 2E is a top elevational view of the collar clip in FIG. 1.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required.

The following description should be viewed in light of FIGS. 1-4. Adverting now to the figures, FIG. 1A is a top perspective view of collar clip 10. FIG. 1B is a bottom perspective view of collar clip 10. FIG. 2A is a front elevational view of collar clip 10. FIG. 2B is a rear elevational view of collar clip 10. FIG. 2C is a right side elevational view of collar clip 10. FIG. 2D is a left side elevational view of collar clip 10. FIG. 2E is a top elevational view of collar clip 10. FIG. 2F is a bottom elevational view of collar clip 10. Collar clip 10 generally comprises collar 20 and clip 50.

Collar 20 is substantially tubular having cylindrical portion 20A and frusto-conical portion 20B. Collar 20 comprises outward facing surface 22, inward facing surface 24, top 26, and bottom 28. In an example embodiment, bottom 28 is a substantially circular edge arranged to fit over a canister, as is discussed in greater detail below. It should be appreciated that bottom 28 may comprise any geometry suitable for securing collar 20 onto a canister, for example, ovular, triangular, square, rectangular, etc. In an example embodiment, top 26 is a substantially circular edge arranged to engage a nozzle. It should be appreciated that top 26 may comprise any geometry suitable for securing collar 20 onto a canister, for example, ovular, triangular, square, rectangular, etc. Collar 20 further comprises notch 30 arranged proximate top 26. Notch 30 is substantially rectangular in shape and protrudes radially outward from outward facing surface 22. Notch 30 is arranged to engage a nozzle such that the nozzle and collar clip 10 are non-rotatably connected, as will be discussed in greater detail below. Collar 20 further comprises alignment fins 32. Alignment fins 32 are arranged proximate top 26 and protrude radially inward from inward facing surface 24. Alignment fins 32 have a substantially triangular shape and are arranged to abut against the top of a canister, as will be discussed in greater detail below. Alignment fins 32 allow collar 20 to be aligned on top of and secured against the canister. In the embodiment shown, collar 20 comprises ten (10) alignment fins. It should be appreciated that any number of alignment fins suitable to secure collar 20 to a canister may be used. It should also be appreciated that alignment fins 32 may comprise any geometry suitable for securing collar 20 onto a canister, for example, ovular, triangular, square, rectangular, etc. In an example embodiment, top 26 is a substantially circular edge arranged to engage a nozzle.

Clip 50 comprises end 52, end 54, side 56, side 58, inward facing side 60, and outward facing side 62. Clip 50 is connected to collar 20. Specifically, end 52 is connected to cylindrical portion 20A. In an example embodiment, end 52 is connected to frusto-conical portion 20B. Inward facing surface 60 faces radially inward toward the canister. inward facing surface 60 comprises protrusions 64A and 64B arranged proximate end 54. Protrusions 64A and 64B are arranged to contact the canister. It should be appreciated that in the embodiment shown, clip 50 comprises two (2) protrusions. However, any number of protrusions suitable for abutting end 54 against the canister may be used. Outward facing surface 62 faces radially outward away from the canister.

As shown, clip 50 is arranged at angle $\alpha$ measured from notch 30. In an example embodiment, angle $\alpha$ is 90 degrees. Because the nozzle is non-rotatably connected to collar clip 10 via notch 30, the canister to the right side of a user's body with the nozzle facing forward (see FIG. 3). This enables a right-handed user to easily draw the canister from attachment to, for example, a belt and immediately empty the contents therein. In an example embodiment, and for a left-handed user, angle $\alpha$ is 270 degrees. This enables a left-handed user to easily draw the canister from the left side of the body and immediately empty the contents therein. In an example embodiment, clip 50 is secured to collar 20 using any suitable means, such as adhesives, bolts, rivets, screws, nails, and interlocking components. In an example embodiment, clip 50 and collar 20 are formed as one continuous component.

Figure 3:
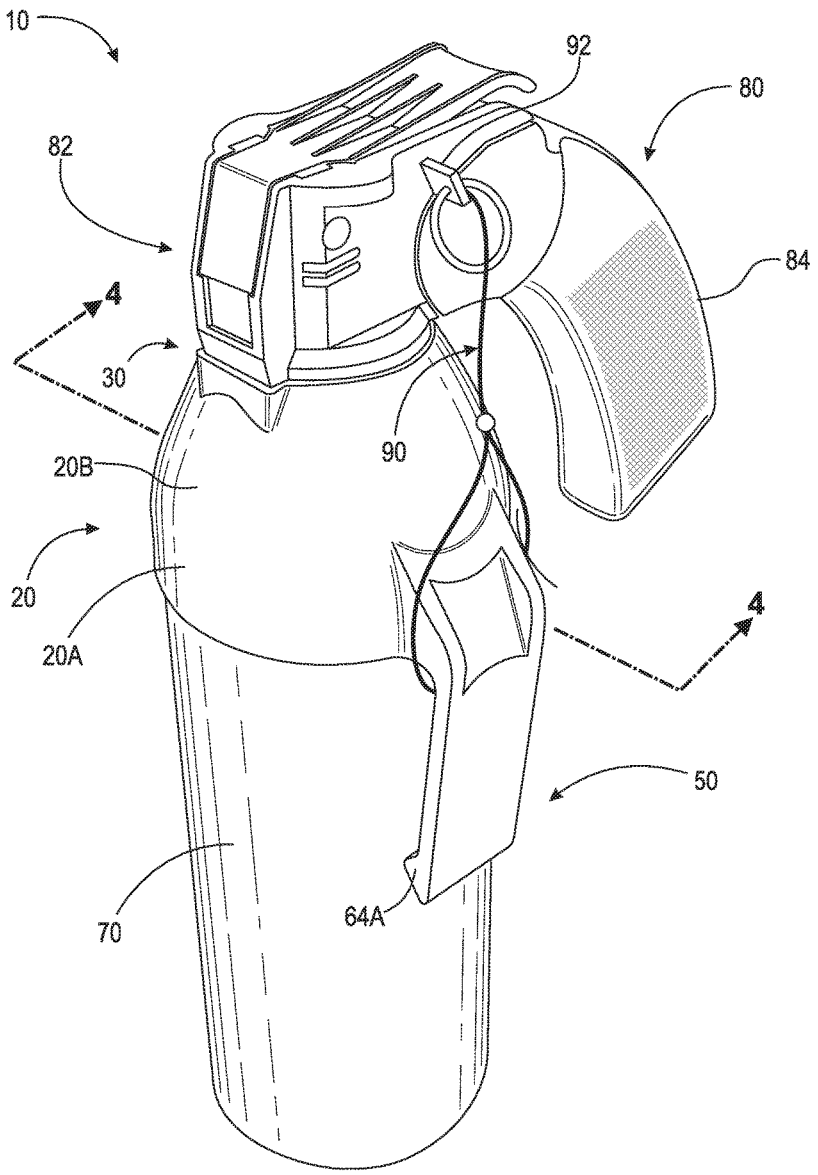
FIG. 3 is a top perspective view of the collar clip shown in FIG. 1 assembled to an aerosol canister; and, FIG. 4 is a cross-sectional view of the collar clip taken generally along line 4-4 in FIG. 3.
Figure 4:
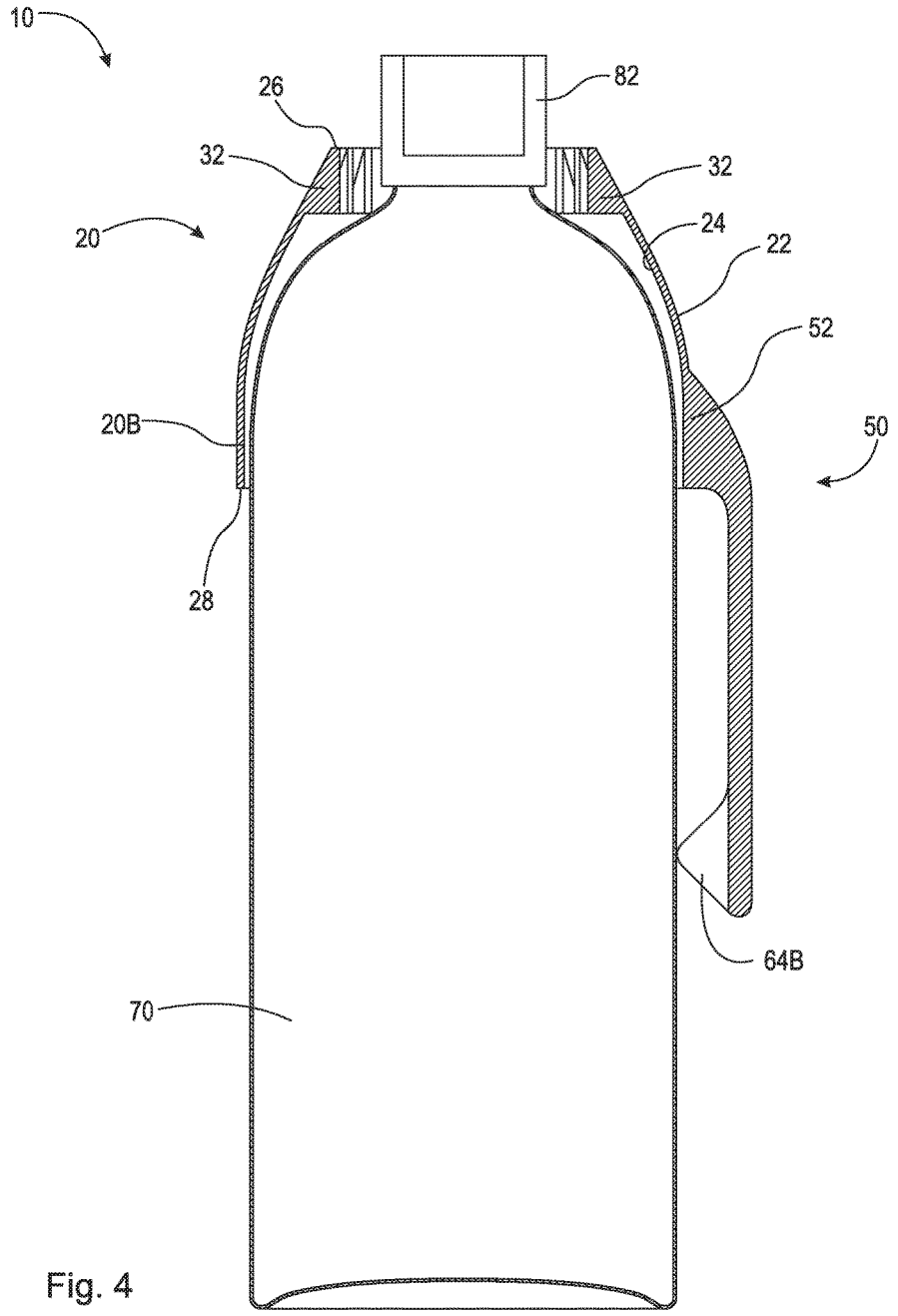

FIG. 3 is a top perspective view of collar clip 10 assembled to aerosol canister 70. FIG. 4 is a cross-sectional view of collar clip 10 taken generally along line 4-4 in FIG. 3. As shown, collar clip 10 is arranged on the top of canister 70 and nozzle 80 is then secured to canister 70. Nozzle 80 prevents collar clip 10 from being removed from canister 70. Nozzle 80 is any nozzle known in the art that secures to the top of a canister, for example, the nozzle disclosed in U.S. Pat. No. 9,216,853 (Caruso), which reference is incorporated herein in its entirety. Nozzle 80 generally comprises front 82 and handle 84. Front 82 engages notch 30 thereby non-rotatably connecting nozzle 80 and collar clip 10. As previously discussed, the embodiment shown allows clip 50 to be secured to the right side of a user with front 82 facing in a forward direction. Protrusion 64A and protrusion 64B (not shown) rests against canister 70 outer surface and prevent lanyard 90 from falling from collar clip 10 when safety pin 92 is removed from nozzle 80. For example, when safety pin 92 is removed from nozzle, safety pin 92 falls and lanyard 90 remains between clip 50 and canister 70. Lanyard 90 may also be used to secure canister 70 to a user or for storing canister 70. As shown in FIG. 4, alignment fins 32 rest against top 72 of canister 70. In an example embodiment, alignment fins 32 may have a concave shape consistent with the curvature of top 72.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Collar clip
20 Collar
20A Cylindrical section
20B Frusto-conical section
22 Outward facing surface
24 Inward facing surface
26 Top
28 Bottom
30 Notch
32 Alignment fins

50 Clip
52 End
54 End
56 Side
58 Side
60 Inward facing surface
62 Outward facing surface
64A Protrusion
64B Protrusion
70 Canister
72 Top
80 Nozzle
82 Front
84 Handle
90 Lanyard
92 Safety pin
α Angle

What is claimed is:

1. A collar clip for securing an aerosol canister, comprising:

a collar arranged to engage the aerosol canister, including:
- a top;
- a bottom;
- a first outward facing surface;
- a first inward facing surface; and,
- a notch arranged proximate the top and extending radially outward from the first outward facing surface; and, a clip, including:
- a first end connected to the collar;
- a second end;
- a second inward facing surface; and,
- a second outward facing surface.

2. The collar clip as recited in claim 1, wherein the collar further comprises a plurality of alignment fins extending radially inward from the first inward facing surface.

3. The collar clip as recited in claim 2, wherein the plurality of alignment fins are arranged proximate the top.

4. The collar clip as recited in claim 3, wherein the plurality of alignment fins are arranged to rest atop the aerosol canister.

5. The collar clip as recited in claim 1, wherein the clip further comprises one or more protrusions extending from the second inward facing surface.

6. The collar clip as recited in claim 5, wherein the one or more protrusions are arranged proximate the second end.

7. The collar clip as recited in claim 1, wherein the clip is arranged at a 90 degree angle relative to the notch.

8. The collar clip as recited in claim 1, wherein the clip is arranged at a 270 degree angle relative to the notch.

9. The collar clip as recited in claim 1, wherein the collar is at least partially frusto-conical.

10. The collar clip as recited in claim 1, wherein the collar is at least partially cylindrical.

11. The collar clip as recited in claim 1, further comprising a lanyard arranged around the clip.

12. A collar clip for securing an aerosol canister, comprising:

a collar arranged to engage the aerosol canister, including:
- a first frusto-conical section defining a top, the first frusto-conical section having:
  - a first outward facing surface; and,
  - a first inward facing surface;
- a second cylindrical section defining a bottom; and,
- a notch arranged proximate the top and extending radially outward from the first outward facing surface; and, a clip, including:
- a first end connected to the second cylindrical section;
- a second end;
- a second inward facing surface; and,
- a second outward facing surface.

13. The collar clip as recited in claim 12, wherein the first frusto-conical section further comprises a plurality of alignment fins extending radially inward from the first inward facing surface.

14. The collar clip as recited in claim 13, wherein the plurality of alignment fins are arranged proximate the top.

15. The collar clip as recited in claim 14, wherein the plurality of alignment fins are arranged to rest atop the aerosol canister.

16. The collar clip as recited in claim 12, wherein the clip further comprises one or more protrusions extending from the second inward facing surface.

17. The collar clip as recited in claim 16, wherein the one or more protrusions are arranged proximate the second end.

18. The collar clip as recited in claim 12, wherein the clip is arranged at a 90 degree angle relative to the notch.

19. The collar clip as recited in claim 12, further comprising a lanyard arranged around the clip.

20. A collar clip and nozzle assembly for securing an aerosol canister, comprising:

a nozzle including a front section;

a collar arranged to engage the aerosol canister, including:
- a top;
- a bottom;
- a first outward facing surface;
- a first inward facing surface;
- a notch:
  - extending radially outward from the first outward facing surface; and,
  - engaged with the front section to non-rotatably connect the collar and the nozzle; and,
- a plurality of alignment fins extending radially inward from the first inward facing surface; and, a clip, including:
- a first end connected to the second cylindrical section;
- a second end;
- a second inward facing surface; and,
- a second outward facing surface.

* * * * *